US006692413B1

(12) United States Patent
Greenberg et al.

(10) Patent No.: US 6,692,413 B1
(45) Date of Patent: Feb. 17, 2004

(54) UN EXERCISE JACKET

(76) Inventors: Barbara L. Greenberg, 1070 E. Knollcrest Dr., Covina, CA (US) 91724; Jack L. Greenberg, 1070 Knollcrest, Covina, CA (US) 91724; Amie S. Greenberg, 1081 Ambassador Dr., Reno, NV (US) 89523

( * ) Notice: Subject to any disclaimer, the term of this patent is extended or adjusted under 35 U.S.C. 154(b) by 0 days.

(21) Appl. No.: 09/295,747

(22) Filed: Apr. 20, 1999

(51) Int. Cl.[7] ..... A63B 21/00; A41D 1/02

(52) U.S. Cl. ..... 482/105; 482/124; 2/108; 2/94

(58) Field of Search ..... 482/124, 105; 2/94, 84, 108, 102, 69, 79, 247, 253

(56) References Cited

U.S. PATENT DOCUMENTS 4,384,369 A * 5/1983 Prince ..... 2/79
4,602,387 A * 7/1986 Zakrzewski ..... 2/102
5,010,596 A * 4/1991 Brown et al. ..... 2/228
5,361,412 A * 11/1994 Perry ..... 2/64
6,081,924 A * 7/2000 Ott ..... 2/102

* cited by examiner

*Primary Examiner*—Jerome W. Donnelly

(57) ABSTRACT

Persons in the elderly population, those with low bone mineral density and those at risk for or who suffer from osteoporosis are in need of resistance training with weight-bearing and can receive the benefits of resistance training with weight-bearing by wearing a jacket with weight inserted into the weight-bearing pockets while walking or performing routine daily activities. The novelty of the pockets is in their 45 degree angle and placement. The jacket provides the benefits of weight-bearing with resistance training which can help with the ailments associated with aging, decrease or stop the loss of bone volume density associated with osteoporosis, increase muscle coordination, increase muscle mass and improve balance.

18 Claims, 4 Drawing Sheets

UN EXERCISE JACKET

BACKGROUND OF THE INVENTION

1. Field of Invention

This invention relates to a garment, particularly to a jacket that can be worn during ordinary activities to obtain the benefits of resistance training when engaging in weight bearing activities.

2. State of the Art

One of the fastest growing segments of the population is over the age of 55. The increase in longevity is associated with an increase in physical problems, including those associated with the bones, muscles and joints. As people age, their bones begin to deteriorate by losing their volume, which can result in osteoporosis. Osteoporosis is a disease characterized by low bone mineral density and diminished bone quality that leads to enhanced bone fragility with increased risks of fracture. With osteoporosis bones become more fragile and are more likely to break. If this disease is not prevented or if it is left untreated, it can progress until a bone breaks. Breaks in the bone, known as fractures, typically occur in the hips, spine, and wrists. Fractures of the hip and spine generally require hospitalization and surgery. These fractures can impair one's ability to walk in an unassisted fashion and can lead to disability or even death. A spinal or fracture of the vertebrae can also cause other problems including the loss of height, back pain and deformity. Osteoporosis, low bone mineral density and the dangers associated with them affect millions of people.

Exercise, specifically, resistance training with weight bearing activity is important to the health and well being of the human body. Resistance training while engaging in weight-baring activity helps to relieve and reduce the ailments associated with aging, low bone mineral density, and osteoporosis.

Among those who need to exercise are those with low bone mineral density, those at risk for or suffering from osteoporosis and the elderly, especially women, who may have a high risk of developing osteoporosis with subsequent dangers of immobility and fractures in the wrists, spine, hips and knees. However, many who are elderly are unable to exercise due to poor muscle tone, muscle wasting, decreased bone mass, and other physical problems associated with the bones, muscles and joints. This lack of exercise further increases the risk of injury to muscles, bones and joints. The poor muscle tone also leads to poor posture and balance problems. The balance problems can, in turn, lead to accidental falls, slips, tripping, and the like, which further increases the risk of injury.

Additionally, many of those most in need of exercise are reluctant, unwilling or unable to wear conventional exercise clothing or exercise in a conventional way at a health club or athletic facility due to the lack of time, lack of desire, lack of skill, ability or knowledge of exercise. However, these populations will go for a walk and will engage in routine daily activities such as housework, gardening, shopping, dog walking, and mall walking.

There is a need for a garment, which promotes resistance training while engaging in weight-bearing activities, without going to a health club, without engaging in traditional vigorous exercise routines and without the need for wearing traditional exercise clothing, but by simply donning a jacket and going for a walk or engaging in routine daily activities.

One way of promoting resistance training while engaging in weight-bearing activity is to gear an article of clothing, a jacket, which fits comfortably like a regular jacket would fit on the body of a user that provides benefits while walking or engaging in routine and daily activities, but does not look like exercise apparel or exercise equipment.

Resistance training while engaging in weight-bearing activity is encouraged by wearing a jacket with weight inserted into weight-bearing pockets while walking, while performing routine activities such as housework, shopping, gardening or during other types of more strenuous activities such as hiking or race-walking. The jacket adds resistance in the form of weight to weight-bearing activities such as walking or routine daily activity. Resistance training added to weight-bearing activities can decrease or stop the loss of bone volume density associated with osteoporosis, increase muscle coordination, increase muscle mass and improve balance. Wearing this jacket while walking or while performing routine daily activities can reduce the amount of bone and muscle loss seen in people as they age, it can foster an increase in muscle growth and it can strengthen and tone muscles in all areas of the body, which would normally decrease in mass and strength with increasing age.

The jacket is designed to look like a regular jacket, so that no one would know it has a purpose other than comfort, aesthetics and warmth.

Resistance training while engaging in weight-bearing activity is encouraged by wearing a jacket with weight inserted into weight-bearing pockets whose novelty is in the angle and placement of the weight-bearing pockets. The jacket, referred to as the Un Exercise Jacket, will be referred to as jacket.

The jacket is not designed to be used while running, during strenuous athletic exercise or training.

DESCRIPTION OF PRIOR ART

Different types of exercise garments have been developed in the past, each of which has been developed or designed for a specific purpose. There have been exercise garments which have been designed for sports and fitness training, designed to increase an athletes physical strength and physical abilities, designed for exercise enthusiasts, and designed to improve physical appearance.

Unlike traditional exercise garments designed to carry heavy weight loads that are geared toward younger populations, exercise enthusiasts, athletes and those training for athletic competitions, the jacket is designed for populations who are middle aged, elderly, at risk for or suffering from osteoporosis or low bone mineral density, who are in poor shape, who do not, will not or physically cannot engage in traditional exercise and could not physiologically use a garment designed with heavy weight loads.

Traditional exercise garments are designed to assist athletes who are in top physical condition and can physically withstand stress placed on varied areas of the body through the use of heavy weight loads and placement of weight loads on various parts of the body in order to improve strength, stamina and physical abilities during fitness and sports training. Unlike traditional exercise garments designed for athletes and those in top physical shape whose bodies can withstand various stresses from the garment in order to improve strength training, populations consisting of the middle aged, elderly, those at risk for or suffering from osteoporosis or low bone mineral density, and those who are in poor shape, could not physiologically withstand using a garment designed for an athlete because it would be detrimental, could put too much stress on the neck, shoulders and lower spine and could cause damage and injury to these structures and these populations could not physiologically use a garment designed with heavy weight loads.

U.S. Pat. No. 4,384,369 (Prince) discloses an exercise suit, which includes both a jacket and pants with pockets designed for the athlete. The pockets carry bags containing a liquid that are vertically placed on the apparatus.

U.S. Pat. No. 5,010,596 (Brown et al.) discloses a garment formed with shorts designed for improving an athlete's physical condition in sporting activities. The apparatus has pockets on both the torso and the lower extremities, which accept weights in a vertical placement.

U.S. Pat. No. 4,602,387 (Zakrzewski) discloses a weight vest, which is lined and is designed to carry weight upwards of 50 pounds. This apparatus is designed for athletes involved in sports and fitness training to increase strength and the physical abilities. The weights are placed in columns.

U.S. Pat. No. 5,361,412 (Perry) discloses a vest apparatus with a plurality of pockets to accept and hold items to sustain the user during emergency situations or for survival purposes.

The weight in the jacket is positioned in pockets placed on a 45 degree angle which are positioned on specific areas of the upper torso to provide benefits to the wearer without placing stress or tension on the spine, the muscles surrounding the spine or other parts of the body which may be fragile due to the effects of aging, low bone mineral density or from osteoporosis. The jacket is designed in varied sizes to ensure proper placement of the weight in the jacket.

SUMMARY OF THE INVENTION

The increase in the longevity of our population is associated with an increase in physical problems, including those problems associated with the bones, muscles and joints. The effects and ailments associated with aging, with low bone mineral density and osteoporosis can be devastating to one's health and ability to function independently.

The purpose of the invention is to promote resistance training while engaging in weight bearing activity in the elderly population, those with low bone mineral density and those at risk for or who suffer from osteoporosis. These populations are in need of weight-bearing activities with resistance training but are reluctant, unwilling or unable to wear conventional exercise clothing or exercise in a conventional way at a health club or athletic facility due to the lack of time, lack of desire, lack of skill, ability or knowledge of exercise. However, these populations will go for a walk or will perform routine daily activities in an article of clothing, like a jacket, that can be comfortably worn.

Promoting weight-bearing activities with resistance training in these populations is accomplished by wearing a jacket with weight inserted into weight-bearing pockets whose novelty is in the 45 degree of the angle of the pockets, which follows and pulls in the direction of the muscle contraction, and the specific placement of the pockets.

The 45 degree angle and strategic placement of the pockets promotes resistance training added to weight-bearing activities which can decrease or stop the loss of bone volume density associated with osteoporosis, increase muscle coordination, improve balance, foster an increase in muscle growth and strengthen and tone muscles in all areas of the body, which would normally decrease in mass and strength with increasing age.

The 45 degree angle which flow in the direction of the muscle contraction, and the strategic placement of the pockets provides the benefits of resistance training while engaging in weight bearing activities without placing stress or tension on the body.

Promoting resistance training with weight bearing activity without placing stress on specific body regions is vital in these populations because these populations do not exercise, are not physically fit and may be frail and unable to handle any physical stress, which could be highly detrimental. Among the objects of the present invention are the following:

To provide a new and useful jacket apparatus;

To provide a new and useful jacket apparatus with pockets having a unique angle, designed to follow the direction of the muscle contraction, which are strategically placed to provide benefits to the human body without placing stress on the body.

To provide a new and useful jacket apparatus which promotes weight-bearing activities with resistance training in the elderly population, those with low bone mineral density and those at risk for or who suffer from osteoporosis who are in need of weight bearing with resistance training but are reluctant, unwilling or unable to wear conventional exercise clothing or exercise in a conventional way but will go for a walk or will perform routine daily activities in an article of clothing like a jacket that is comfortable, not form fitting like traditional exercise attire and looks like a regular jacket.

This invention comprises a jacket body with a front and back having an inner surface and an outer surface; a back section connected to two front sections which extend forward from the back section to form the jacket of a size appropriate to be worn by an adult human; formed with a left body half and a right body half; front sections have a zipper fastener means which interconnects and releases front edges of the two body halves so said jacket can be opened and closed; long sleeves to be worn on the upper torso of a user; eight weight-bearing pockets stitched to the inner surface of the jacket body; a pair of the first weight-bearing pockets are disposed on the right and left back sections of the inner surface of the jacket; a pair of the second weight-bearing pockets are disposed on the right and left back sections of the inner surface of the jacket below the pair of the first weight-bearing pockets; a pair of third weight-bearing pockets are disposed on the right and left front sections of the inner surface of the jacket; a pair of the fourth weight-bearing pockets are disposed on the right and left front sections of the inner surface of the jacket below the pair of the third weight-bearing pockets; the pair of the first, second, third and fourth weight-bearing pockets are placed and positioned at an angle 45 degrees symmetrically from the vertical axis of the spine; a single weight is accepted into the pair of the first, second, third and fourth weight bearing pockets; a hook and loop fastener means stitched to the inner surface of the jacket body mates with a complimentary hook and loop fastener means stitched to and located on the top opening edge of the inner surface of the pair of the first, second, third and fourth weight-bearing pockets as a member for opening and closing the pair of the first, second, third and fourth weight-bearing pockets and securing the weight in the weight-baring pockets.

The pair of the first weight-bearing pockets are placed on an angle 45 degrees symmetrically from the vertical axis of the spine between the third and fourth thoracic vertebrae and flow in the same direction as the muscle contraction. Placing a weight into the pair of the first weight-bearing pockets places the spine and the muscles surrounding the spine into proper physiologic position. By placing the pair of the first weight-bearing pockets on an angle between the third and fourth thoracic vertebrae with the spine aligned properly while engaging in weight-bearing activity, such as walking with the resistance from adding weight into the pair of the first pockets has a positive stimulating effect on the bones and joints of the spine. The stimulating effect on bones and joints of the spine helps to prevent and treat osteoporosis, low bone mineral density, helps prevent and treat the ailments associated with aging, and increases muscularity in the spine and the muscles surrounding the spine that have a tendency to atrophy with age and lack of activity.

The pair of the second weight-bearing pockets are placed on an angle 45 degrees symmetrically from the vertical axis of the spine at the level of the lower thoracic spine starting at the seventh thoracic vertebrae one-half inch from the midline of the spine extending laterally following the eighth and ninth ribs and flow in the same direction as the muscle contraction. Placing weight into the pair of the second weight-bearing pockets and engaging in weight-bearing activity, such as walking, with the resistance from adding weight into the pair of the second weight-bearing pockets has a positive stimulating effect on the spine, the lower thoracic and lumbar vertebrae and the hips. This stimulating effect helps to prevent and treat osteoporosis and low bone mineral density. Osteoporosis has a devastating effect on the spine, the lower thoracic and lumbar vertebrae and the hips.

The pair of the third weight-bearing pockets are positioned on an angle 45 degrees from the vertical axis of the spine at the lower rib cage at the level of the anterior axillary line between the $8^{th}$ and $10^{th}$ ribs with the lower ends being furthest from the spine with the pockets flowing in the same direction as the muscle contraction. The pair of the third weight-bearing pockets counterbalances the pair of the first weight-bearing pockets, which prevents hyperextension, or overextension of the spine. The counterbalance is important because any change in the spine or the muscles along side of the spine can lead to injury.

The pair of the fourth weight-bearing pockets are positioned on an angle 45 degrees from the vertical axis of the spine below the level of the waist and are slanted diagonally downward over the hip and outer thigh. The pair of the fourth weight-bearing pockets counterbalances the pair of the second weight-bearing pockets, which helps the spine maintain proper positioning which prevents potential injury to the spine, and the lower thoracic and lumbar vertebrae.

Each pair of the first, second, third and fourth weight-bearing pockets receive one weight therein which comes in increments of 0.5 to 1.5 pounds. The amount of weight increments used depends upon the physical ability of each individual donning the jacket. The jacket can be donned with as little as 2 pounds by placing a 0.5 pound weight in the pair of the first weight-bearing pockets and counterbalancing that by placing a 0.5 pound weight in the pair of the third weight-bearing pockets. It is recommended that individuals in the aging population, those with low bone mineral density, and those suffering from or at risk for osteoporosis who have fragile physical conditions should begin by donning the jacket with a maximum of 2 pounds. The Jacket can hold up to 12 pounds by placing a 1.5 pound weight into each pair of the first, second, third and fourth weight-bearing pockets. Each of the pair of the first and third and second-hand fourth weight-bearing pockets must receive the identical weight increment for proper symmetry and balance.

BRIEF DESCRIPTION OF THE DRAWINGS

Drawings

Cancel the drawings referred to as FIGS. 1 and 2 and replace with new FIGS. 1, 2, 3, and 4. The description refers to the accompanying drawings in which like reference characters refer to like parts throughout the several views, and in which.

REFERENCE NUMERALS IN DRAWINGS

Figure 1:
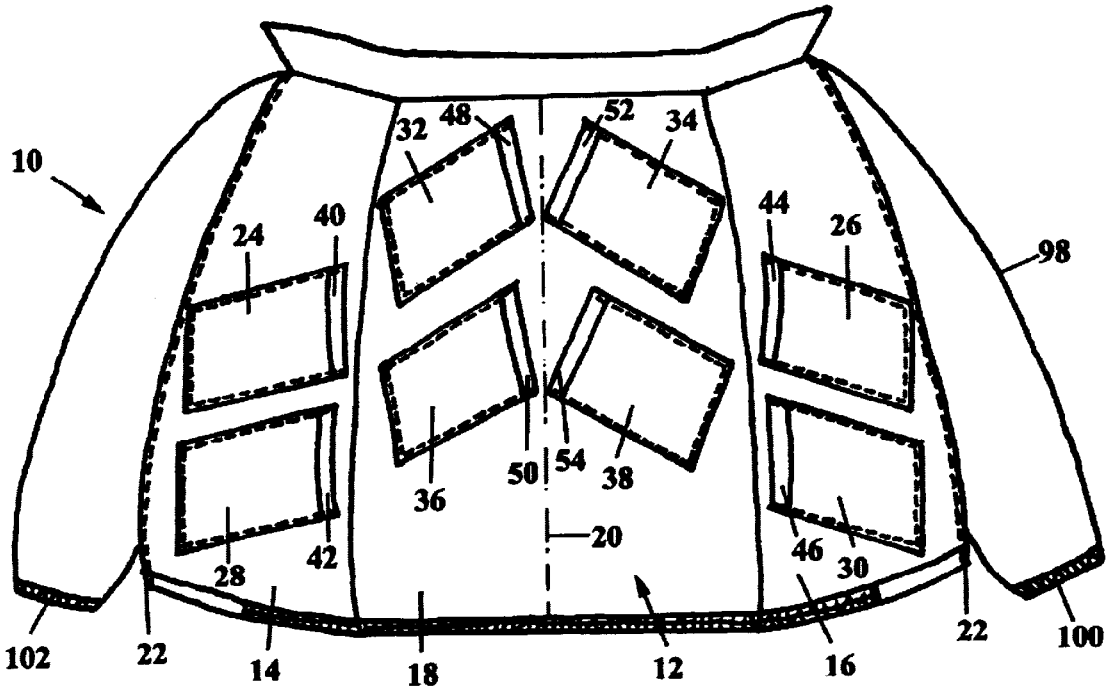
FIG. 1 which illustrates an inside view of the open weight-bearing jacket which shows the inner jacket surface and the angled placement of the eight weight-bearing pockets.

10 jacket
12 jacket body
14 wearer's right front inside jacket panel
16 wearer's left front inside jacket panel
18 back inside jacket panel
20 centerline
22 zipper
24 wearer's right upper front pocket stitched to inner jacket surface
26 wearer's left upper front pocket stitched to inner jacket surface
28 wearer's right lower front pocket stitched to inner jacket surface
30 wearer's left lower front pocket stitched to inner jacket surface
32 wearer's right upper back pocket stitched to inner jacket surface
34 wearer's left upper back pocket stitched to inner jacket surface
36 wearer's right lower back pocket stitched to inner jacket surface
38 wearer's left lower back pocket stitched to inner jacket surface
40 top opening on wearer's right upper front pocket
42 top opening on wearer's right lower front pocket
44 top opening on wearer's left upper front pocket
46 top opening on wearer's left lower front pocket
48 top opening on wearer's right upper back pocket
50 top opening on wearer's right lower back pocket
52 top opening on wearer's left upper back pocket
54 top opening on wearer's left lower back pocket
56 wearer's left front half of jacket
58 wearer's right front half of jacket
60 wearer's left back half of jacket
62 wearer's right back half of jacket
64 hook and loop fastener stitched to wearer's right upper front inside flap of jacket
66 hook and loop fastener stitched to wearer's right lower front inside flap of jacket
68 hook and loop fastener stitched to wearer's left upper front inside flap of jacket
70 hook and loop fastener stitched to wearer's left lower front inside flap of jacket
72 hook and loop fastener stitched to wearer's right upper back inside flap of jacket

74 hook and loop fastener stitched to wearer's right lower back inside flap of jacket
76 hook and loop fastener stitched to wearer's left upper back inside flap of jacket
78 hook and loop fastener stitched to wearer's left lower back inside flap of jacket
80 hook and loop fastener stitched to inside of wearer's right upper front pocket
82 hook and loop fastener stitched to inside of wearer's right lower front pocket
84 hook and loop fastener stitched to inside of wearer's left upper front pocket
86 hook and loop fastener stitched to inside of wearer's left lower front pocket
88 hook and loop fastener stitched to inside of wearer's right upper back pocket
90 hook and loop fastener stitched to inside of wearer's right lower back pocket
92 hook and loop fastener stitched to inside of wearer's left upper back pocket
94 hook and loop fastener stitched to inside of wearer's left lower back pocket
96 weight
98 long sleeves
100 arm opening
102 arm opening

DETAILED DESCRIPTION OF THE PREFERRED EMBODIMENT

Referring to the drawings, FIGS. 1, 2, 3, and 4 illustrate a preferred weight-bearing jacket 10 having a body 12. The jacket 10 will be made of canvas or similar material, cotton, heavy nylon or polyester with a mesh material used as a lining.

Figure 2:
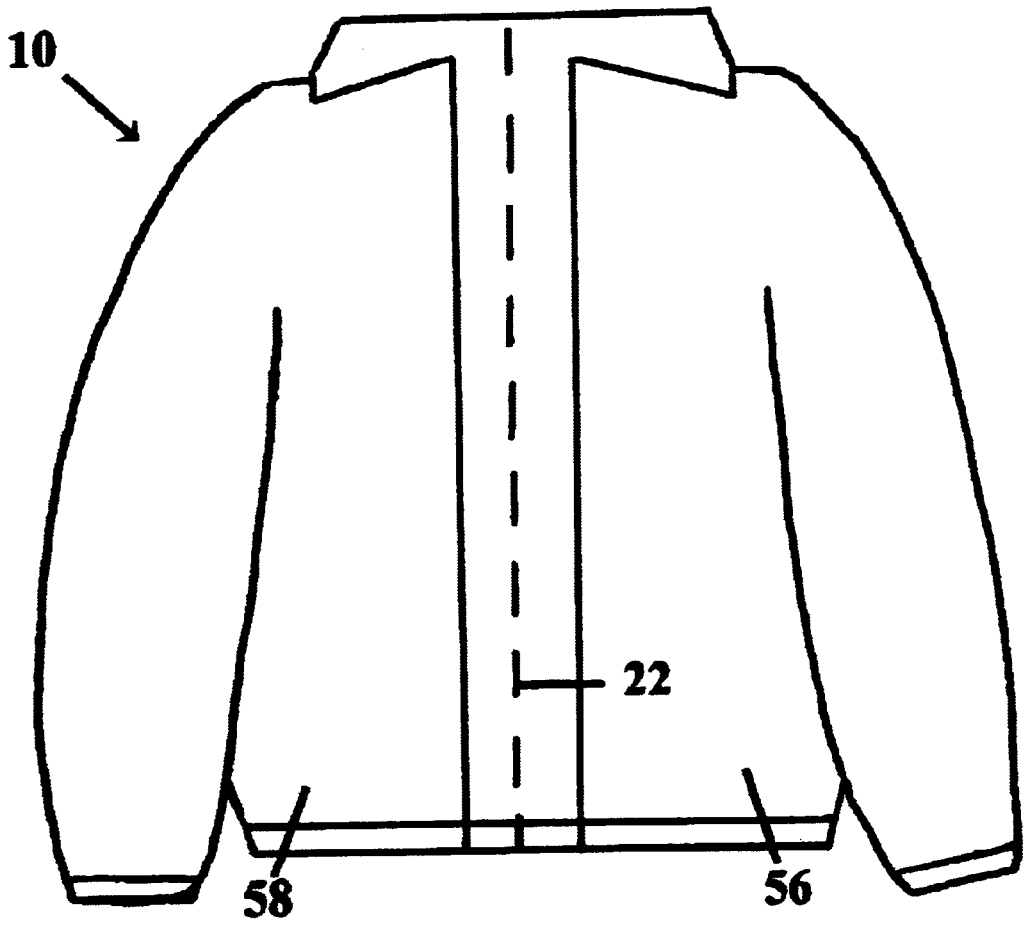
FIG. 2 illustrates a front view of the preferred weight-bearing jacket.
Figure 3:
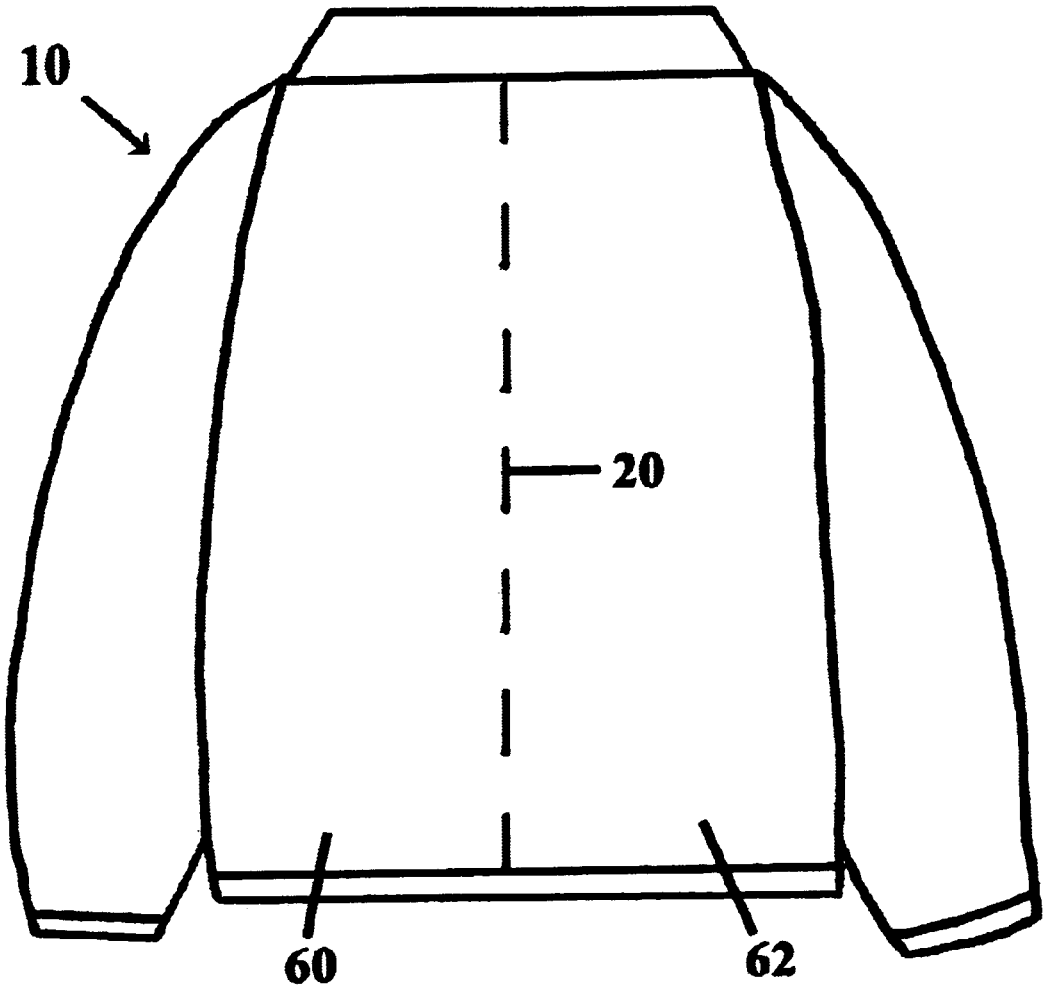
FIG. 3 illustrates a back view of the preferred weight-bearing jacket.

As seen in FIGS. 2 and 3, the jacket 10 is formed with a wearer's left front half 56 and a right front half 58 and a wearer's back left half 60 and a right back half 62 vertically snitched up the back at 20. FIGS. 1, 2, 3, and 4 illustrate jacket 10 with long sleeves 98. The body 12 of jacket 10 has a pair of arm openings 100 and 102. FIGS. 1, 2, 3 and 4 illustrate a zipper fastener 22, which joins and releases the front edges of the two body halves so that the jacket 10 can be opened and closed.

In general, the jacket has a front and a back defining an outer surface and an inner surface. The back of the jacket 10 is connected to the front to form a garment of a size appropriate to be worn on the torso of a human being.

Figure 4:
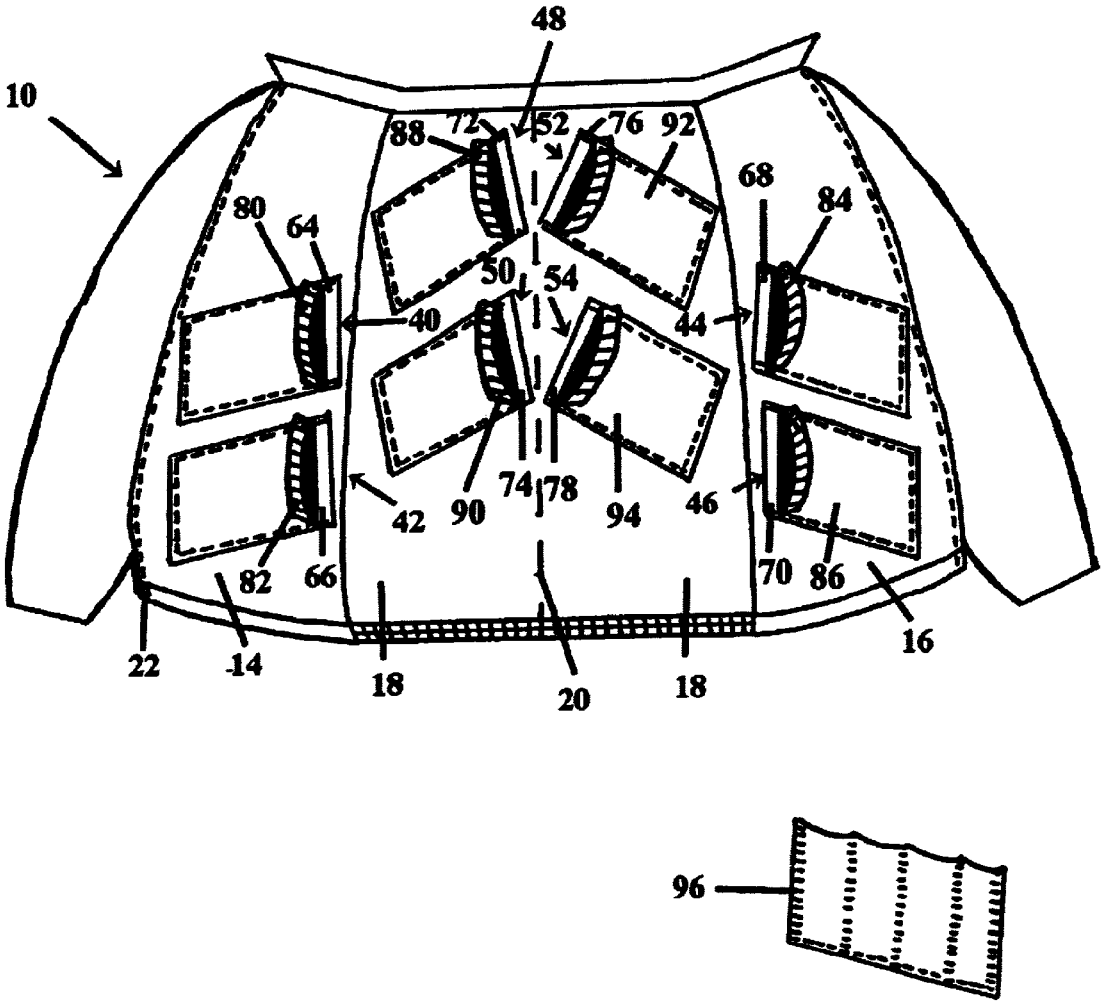
FIG. 4 is an inside view of the open weight-bearing jacket showing the jacket inner surface, the weight, and the manner in which a hook and loop fastener means is stitched to the inner jacket surface and how it mates with a complimentary hook and loop fastener means stitched to and located on the top opening edge of the inner surface of the weight-bearing pockets as a means for opening and closing the weight-bearing pockets.

FIG. 1 illustrates a front inside view of the inner surfaces 14, 16, 18 of the preferred weight-bearing jacket 10. Referring to FIGS. 1 and 4, eight weight-bearing pockets 24, 26, 28, 30, 32, 34, 36, 38 are stitched to the inner surface of the jacket body 12.

Referring to FIGS. 1 and 4, eight weight-bearing pockets 24, 26, 28, 30, 32, 34, 36, 38 are positioned at an angle of 45 degrees symmetrically from the vertical axis of the spine, as defined by centerline 20.

Referring to FIGS. 1 and 4, weight-bearing pockets 32 and 34 are positioned between the third and fourth thoracic vertebrae.

Referring to FIGS. 1 and 4, weight-bearing pockets 36 and 38 are positioned at the level of the lower thoracic spine starting at the seventh thoracic vertebrae one-half inch from the midline of the spine extending laterally following the eighth and ninth ribs.

Referring to FIGS. 1 and 4, weight-bearing pockets 24 and 26 are positioned at the lower rib cage at the level of the anterior axillary line between the $8^{th}$ and $10^{th}$ ribs with the ends disposed at an angle toward the umbilicus.

Referring to FIGS. 1 and 4, weight-bearing pockets 28 and 30 are positioned below the level of the waist and are slanted diagonally downward over the hip and outer thigh with the ends disposed at an angle toward the umbilicus.

As seen in FIGS. 1 and 4, weight-bearing pockets 24, 26, 28, 30 are stitched on an angle to the inner surface 14, 16 of the jacket body 12. FIG. 1 shows weight-bearing pockets 24 and 28 stitched on a 45 degree angle to a wearer's right front inside flap 14 of jacket body 12. FIG. 1 shows weight-bearing pockets 26 and 30 stitched on a 45 degree angle to the wearer's left front inside flap 16 of jacket body 12.

As seen in FIGS. 1 and 4, weight-bearing pockets 32, 34, 36, 38, are stitched on a 45 degree angle to the back inner surface 18 of jacket body 12.

FIGS. 1 and 4 show weight-bearing pockets 24 and 28 are placed on the wearer's right side of centerline 20 symmetrically opposite to weight-bearing pockets 26 and 30, which are placed on the wearer's left side of centerline 20 of jacket body 12.

FIGS. 1 and 4 show weight-bearing pockets 32 and 36 are placed on the back panel 18 to the wearer's right side of centerline 20 symmetrically opposite to weight-bearing pockets 34 and 38, which are placed on the wearer's left side of centerline 20 of back panel 18 of jacket body 12.

Referring to FIG. 1, weight-bearing pockets 24 and 28 are placed on front panel 14 to counterbalance weight-bearing pockets 26 and 30, which are placed on front panel 16.

Referring to FIG. 1, weight-bearing pockets 24, 28, 26, and 30 have top openings 40, 42, 44, and 46. Referring to FIG. 1, weight-bearing pockets 32, 36, 34, 38 have top openings 48, 50,52,54.

Referring to FIG. 4, weight-bearing pockets 24, 26, 28, 30, 32, 34, 36, and 38 receive one weight 96. Weight 96 is rectangular and is about 4 to 6." long and about 2.5 to 4" wide and about 1.5 to 3 inches high and is made of a canvas or similar material, which is filled, with iron or a similar substance. Each weight-bearing pocket 24, 26, 28, 30, 32, 34, 36, and 38 holds one weight 96. Weight 96 is placed into said weight-bearing pockets 24, 26, 28, 30, 32, 34, 36, and 38 through top openings 40, 42, 44, 46 48, 50, 52, 54. Weight 96 can be increased from 0.5 pounds to 2 pounds. The weight increments of 0.5 to 2 pounds provide enough weight to ensure proper weight bearing with resistance training without injuring these structures.

Each of the weight-bearing pockets 24, 26, 28, 30, 32, 34, 36, and 38 must carry the same weight increment for proper symmetry and balance. Each of the weight-bearing pockets 24, 26, 28, 30, 32, 34, 36, and 38 must each be filled with only one weight 96 for proper symmetry and balance.

Referring to FIGS. 1 and 4, each of the weight-bearing pockets 24, 26, 28, 30, 32, 34, 36, and 38 has a similar configuration, which is, about 4 to 6 inches long, about 2.5 to 4 inches wide and about 1.5 to 3 inches high.

As seen in FIG. 4, the inner surface 14, 16, and 18, is stitched with 8 patches of the VELCRO trademark, hook and loop fastener means 64, 66, 68, 70, 72, 74, 76, 78, which mate with a complimentary VELCRO trademark hook and loop fastener means 80, 82, 84, 86, 88, 90, 92, 94 as a means for opening and closing the weight-bearing pockets 24, 26, 28, 30, 32, 34, 36, and 38. FIG. 4 shows the complimentary VELCRO trademark hook and loop fastener means 80, 82, 84, 86, 88, 90, 92, 94 is stitched to and located on the top opening edge 40, 42, 44, 46, 48, 50, 52, 54, of the inner surface of weight-bearing pockets 24, 26, 28, 30, 32, 34, 36, and 38.

The design of the jacket can readily promote weight bearing with resistance training. Donning jacket 10 with weight 96 placed into weight-bearing pockets 24, 26, 28, 30, 32, 34, 36, and 38 can decrease or stop the loss of bone volume density associated with osteoporosis, increase muscle coordination, increase muscle growth, improve balance and foster an increase in muscle growth and it strengthen and tone muscles in all areas of the body, which would normally decrease in mass and strength with increasing age.

The invention has been described by reference to specific examples and embodiments. Variations, modifications, and alterations will naturally suggest themselves to those of the usual level of skill in this art. The appended claims are intended to encompass all such variations, modifications and alterations.

We claim:

1. A jacket which promotes resistance training while walking or performing routine daily activity in the aging population, in those with low bone mineral density and in those at risk for or who suffer from osteoporosis and provides benefits without these populations having to exercise in a conventional way, without these populations having to engage in running, strenuous athletic exercise or training and without these populations having to wear traditional exercise garments comprising: a pair of long sleeves; a back section connected to right and left front sections which extend forward from said back section to form said jacket; said front sections having a zipper fastener member for detachably securing the right and left sections together; said front and back sections have inner and outer surfaces respectively; a pair of first weight-bearing pockets stitched to an upper portion said inner surface of said right and left back sections of said jacket; a pair of second weight-bearing pockets stitched to a lower portion of said inner surface of said right and left back sections of said jacket; a pair of third weight-bearing pockets stitched to said upper portion of said inner surface of said right and left front sections of said jacket; a pair of fourth weight-bearing pockets stitched to said lower portion of said inner surface of said right and left front sections of said jacket; the pair of the first, second, third and fourth weight-bearing pockets are positioned at an angle 45 degrees symmetrically from the vertical axis of the spine which anatomically and physiologically forces the pair of said first, second, third and fourth weight-bearing pockets to run in the direction of the muscle contraction which reduces the potential for damage and injury to the upper and mid spine, the chest, the back and neck because the angle allows for the pulling to occur in the direction of the muscle fibers; the pair of said first, second, third and fourth weight-bearing pockets are positioned at an angle 45 degrees symmetrically from the vertical axis of the spine which prevents the weight from pulling against or in the opposite direction of the long axis of the muscle fibers; the pair of said first, second, third and fourth weight-bearing pockets have the lower end of said pockets being furthest away from the spine; the pair of the first and second weight-bearing pockets extend laterally following the ribs; the pair of the third and fourth weight-bearing pockets have the lower end of said pockets angled toward the umbilicus; a single weight is inserted into each pair of said first, second, third and fourth weight-bearing pockets; a hook and loop fastener stitched at a top edge of each pair of said first, second, third and fourth pockets for detachable attachment to a complimentary fastener stitched to the inner surface of the jacket in order to retain the weight therein.

2. The jacket of claim 1 wherein said pair of first weight-bearing pockets on said back section of said jacket are disposed at an angle of 45 degrees symmetrically from the vertical axis of the spine and are positioned between the third and fourth thoracic vertebrae.

3. The jacket of claim 2 wherein inserting weight into said pair of said first weight-bearing pockets on an angle 45 degrees symmetrically from the vertical axis of the spine places the spine and the muscles surrounding the spine into proper physiologic position, placing thee pair of the first weight-bearing pockets on an angle 45 degrees symmetrically between the third and fourth thoracic vertebrae with the spine aligned properly while engaging in weight-bearing activity such as walking with resistance training from adding weight into said pair of first weight-bearing pockets has a positive stimulating effect on the bones and joints of the spine, the stimulating effect on bones and joints of the spine helps to prevent and treat osteoporosis, low bone mineral density helps prevent and treat the ailments associated with aging, increases muscularity in the spine and the muscles surrounding the spine that have a tendency to atrophy with age and lack of activity.

4. The jacket of claim 2 wherein said pair of first weight-bearing pockets on said back section of said jacket are disposed on said inner surface of said right and left back sections of said jacket.

5. The jacket of claim 1 wherein said pair of second weight-bearing pockets on said back section of said jacket are disposed on an angle 45 degrees symmetrically from the vertical axis of the spine at the level of the lower thoracic spine starting at the seventh thoracic vertebrae one-half inch from the midline of the spine extending laterally following the eighth and ninth ribs.

6. The jacket of claim 5 wherein inserting a weight into said pair of second weight-bearing pockets on an angle 45 degrees symmetrically from the vertical axis of the spine while engaging in weight-bearing activity such as walking with resistance training from adding weight into said pair of second weight-bearing pockets has a positive stimulating effect on the spine, the lower thoracic and lumbar vertebrae and the hips, this stimulating effect helps prevent and treat the ailments associated with aging, increases muscularity in the spine and the muscles surrounding the spine that have a tendency to atrophy with age and lack of activity, helps to prevent and treat low bone mineral density and osteoporosis, which has a devastating effect on the spine, the lower thoracic, and lumbar vertebrae and the hips.

7. The jacket of claim 5 wherein said pair of second weight-bearing pockets on said back section of said jacket are disposed on the inner surface of said right and left back sections of said jacket.

8. The jacket of claim 1 wherein said pair of said third weight-bearing pockets on said front section of said jacket are positioned on an angle 45 degrees symmetrically from the vertical axis of the spine at the lower rib cage at the level of the anterior axillary line between the $8^{th}$ and $10^{th}$ ribs with the lower ends of said pockets being furthest away from the spine and angled toward the umbilicus.

9. The jacket of claim 8 wherein said pair of said third weight-bearing pockets counterbalance said pair of said first weight-bearing pockets which prevents hyperextension and overextension of the spine, said counterbalance is important because anty change in the spine or the muscles along side of the spine can lead to injury.

10. The jacket of claim 8 wherein said pair of third weight-bearing pockets on said front section of said jacket are disposed on said inner surface of said right and left front sections of said jacket.

11. The jacket of claim 1 wherein said pair of said fourth weight-bearing pockets on said front section of said jacket are positioned on an angle 45 degrees symmetrically from the vertical axis of the spine below the level of the waist and are slanted diagonally downward over the hip and outer thigh with the lower end of said pockets angled toward the umbilicus.

12. The jacket of claim 11 wherein said pair of said fourth weight-bearing pockets counterbalance said pair of said second weight-bearing pockets which helps the spine maintain proper positioning which prevents the potential for injury to the spine and to the lower thoracic and lumbar vertebrae.

13. The jacket of claim 12 wherein said pair of said fourth weight-bearing pockets on said front section of said jacket are disposed on said inner surface of said right and left front sections of said jacket.

14. The jacket of claim 1 wherein each pair of said first, second, third and fourth weight-bearing pockets receive one weight therein which comes in increments of 0.5 to 1.5 pounds the amount of weight increments used depends upon the physical ability of each individual donning said jacket, said jacket can be donned with as little as 2 pounds by placing 0.5 pound weight in said pair of said first weight-bearing pockets and counterbalancing that weight by placing a 0.5 pound weight into said pair of said third weight-bearing pockets.

15. The jacket of claim 1 wherein said jacket can hold up to 12 pounds by placing a 1.5 pound weight into each pair of said first, second, third and fourth weight-bearing pockets.

16. The jacket of claim 1 wherein each of the pair of said first and third and each pair of said second and fourth weight-bearing pockets must receive the identical weight increment for proper symmetry and balance.

17. The jacket of claim 1 wherein said pair of said first, second, third and fourth weight-bearing pockets are positioned at an angle 45 degrees symmetrically from the vertical axis of the spine which anatomically and physiologically forces the weight-bearing pockets to run in the same direction as the long-axis of the muscle fibers reducing the risk of injury and forces a gentle traction and stretching of the muscles of the spine forcing the spine to straighten and be placed in proper physiologic position.

18. The jacket of claim 1 wherein said pair of said first, second, third and fourth weight-bearing pockets are positioned in different areas of the thoracic region of the spine to prevent concentration of said weight in one general area, lessening the risk of injury to those who are in a frail or weakened state or who are physically unconditioned due to aging, osteoporosis or low bone mineral density.

* * * * *